US006084520A

United States Patent [19]

Salvucci

[11] Patent Number: 6,084,520

[45] Date of Patent: Jul. 4, 2000

[54] LEAK COLLECTION AND SUPPLY SHUT OFF SYSTEM

[76] Inventor: John G. Salvucci, 59 Holland St., Winchester, Mass. 01890

[21] Appl. No.: 09/124,729

[22] Filed: Jul. 30, 1998

[51] Int. Cl.[7] ..... G08B 17/10

[52] U.S. Cl. ..... 340/605; 340/603; 340/606; 340/612; 340/618; 200/84 R; 200/61.04

[58] Field of Search ..... 340/605, 603, 340/606, 612, 618; 200/84 R, 61.04

[56] References Cited

U.S. PATENT DOCUMENTS

| | | | |
|---|---|---|---|
| 3,069,671 | 12/1962 | Tailor | 340/244 |
| 4,765,360 | 8/1988 | Baird | 137/312 |
| 4,944,253 | 7/1990 | Bellofatto | 122/504 |
| 5,085,205 | 2/1992 | Hall et al. | 126/363 |
| 5,134,683 | 7/1992 | Powell | 392/449 |
| 5,188,143 | 2/1993 | Krebs | 137/312 |
| 5,345,224 | 9/1994 | Brown | 340/605 |
| 5,632,302 | 5/1997 | Lenoir, Jr. | 137/312 |
| 5,645,103 | 7/1997 | Whittaker | 137/312 |
| 5,877,689 | 3/1999 | D'Amico | 340/605 |

*Primary Examiner*—Daniel J. Wu
*Assistant Examiner*—Tai T. Nguyen

[57] ABSTRACT

A new leak collection and supply shut off system for closing off the supply of water and energy to a water heater in the event of a leak. The inventive device is designed for use with a water heater that has a tank, a water inlet pipe, a water outlet pipe, and an energy supply line. The leak collection and supply shut off system comprises a container that is adapted for positioning under a water heater and holding water. The container has a base, a sidewall, and an open top. A water valve closes the water inlet pipe of the water heater when the level of water in the container is equal to or greater than a predetermined level. An energy shut off device closes the energy supply line of the water heater when the level of water in the container is equal to or greater than the predetermined level.

1 Claim, 4 Drawing Sheets

LEAK COLLECTION AND SUPPLY SHUT OFF SYSTEM

BACKGROUND OF THE INVENTION

1. Field of the Invention

The present invention relates to leak detection devices and more particularly pertains to a new leak collection and supply shut off system for closing off the supply of water and energy to a water heater in the event of a leak.

2. Description of the Prior Art

The use of leak detection devices is known in the prior art. More specifically, leak detection devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art leak detection devices include U.S. Pat. No. 4,845,472; U.S. Pat. No. 4,136,823; U.S. Pat. No. 4,916,437; U.S. Pat. No. 4,987,408; U.S. Pat. No. 3,365,661; and U.S. Pat. No. 2,812,976.

While these devices fulfill their respective, particular objectives and requirements, the aforementioned patents do not disclose a new leak collection and supply shut off system. The inventive device is designed for use with a water heater that has a tank, a water inlet pipe, a water outlet pipe, and an energy supply line. The leak collection and supply shut off system comprises a container that is adapted for positioning under a water heater and holding water. The container has a base, a sidewall, and an open top. A water valve closes the water inlet pipe of the water heater when the level of water in the container is equal to or greater than a predetermined level. An energy shut off device closes the energy supply line of the water heater when the level of water in the container is equal to or greater than the predetermined level.

In these respects, the leak collection and supply shut off system according to the present invention substantially departs from the conventional concepts and designs of the prior art, and in so doing provides an apparatus primarily developed for the purpose of closing off the supply of water and energy to a water heater in the event of a leak.

SUMMARY OF THE INVENTION

In view of the foregoing disadvantages inherent in the known types of leak detection devices now present in the prior art, the present invention provides a new leak collection and supply shut off system construction wherein the same can be utilized for closing off the supply of water and energy to a water heater in the event of a leak.

The general purpose of the present invention, which will be described subsequently in greater detail, is to provide a new leak collection and supply shut off system apparatus and method which has many of the advantages of the leak detection devices mentioned heretofore and many novel features that result in a new leak collection and supply shut off system which is not anticipated, rendered obvious, suggested, or even implied by any of the prior art leak detection devices, either alone or in any combination thereof.

To attain this, the present invention generally comprises a container that is adapted for positioning under a water heater and holding water. The container has a base, a sidewall, and an open top. A water valve closes the water inlet pipe of the water heater when the level of water in the container is equal to or greater than a predetermined level. An energy shut off device closes the energy supply line of the water heater when the level of water in the container is equal to or greater than the predetermined level.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new leak collection and supply shut off system apparatus and method which has many of the advantages of the leak detection devices mentioned heretofore and many novel features that result in a new leak collection and supply shut off system which is not anticipated, rendered obvious, suggested, or even implied by any of the prior art leak detection devices, either alone or in any combination thereof.

It is another object of the present invention to provide a new leak collection and supply shut off system which may be easily and efficiently manufactured and marketed.

It is a further object of the present invention to provide a new leak collection and supply shut off system which is of a durable and reliable construction.

An even further object of the present invention is to provide a new leak collection and supply shut off system which is susceptible of a low cost of manufacture with regard to both materials and labor, and which accordingly is then susceptible of low prices of sale to the consuming public, thereby making such leak collection and supply shut off system economically available to the buying public.

Still yet another object of the present invention is to provide a new leak collection and supply shut off system which provides in the apparatuses and methods of the prior art some of the advantages thereof, while simultaneously overcoming some of the disadvantages normally associated therewith.

Still another object of the present invention is to provide a new leak collection and supply shut off system for closing off the supply of water and energy to a water heater in the event of a leak.

Yet another object of the present invention is to provide a new leak collection and supply shut off system which includes a container that is adapted for positioning under a water heater and holding water. The container has a base, a sidewall, and an open top. A water valve closes the water inlet pipe of the water heater when the level of water in the container is equal to or greater than a predetermined level. An energy shut off device closes the energy supply line of the water heater when the level of water in the container is equal to or greater than the predetermined level.

Still yet another object of the present invention is to provide a new leak collection and supply shut off system that prevents damage and waste caused by a leaking water heater.

Even still another object of the present invention is to provide a new leak collection and supply shut off system that continues to remove water that leaks from the water heater even after the water supply is cut off.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
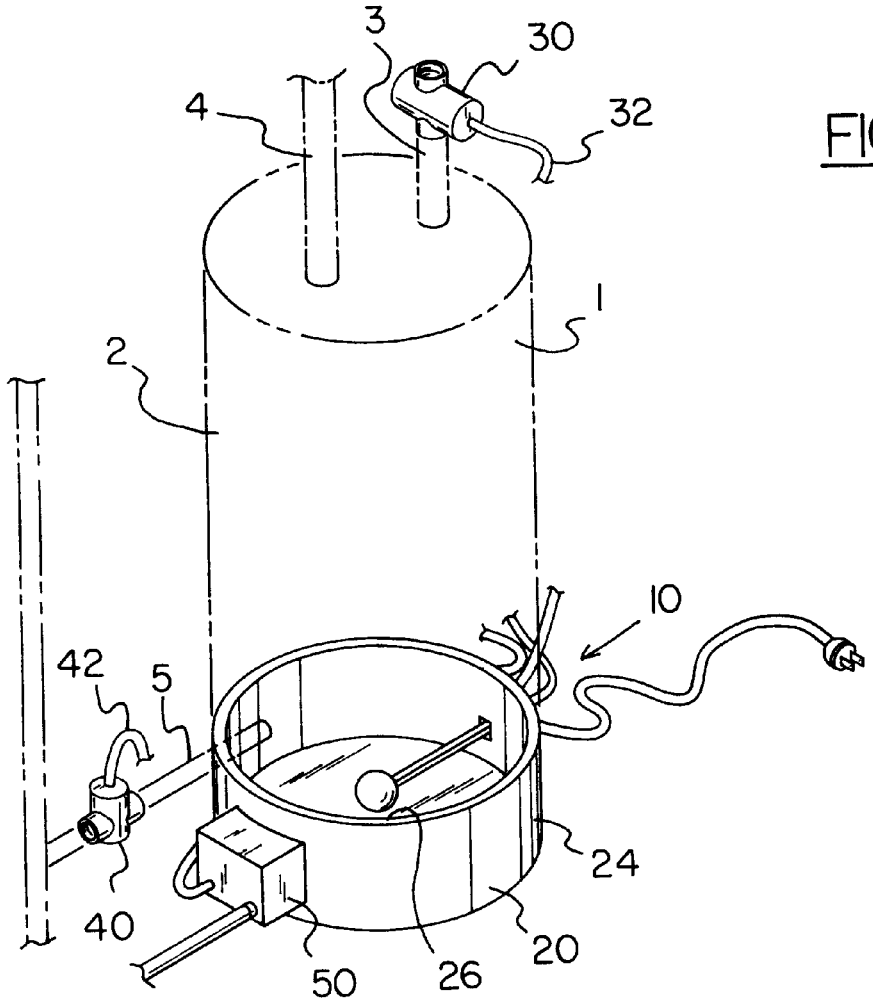
FIG. 1 is a perspective view of a new leak collection and supply shut off system according to the present invention.
Figure 2:
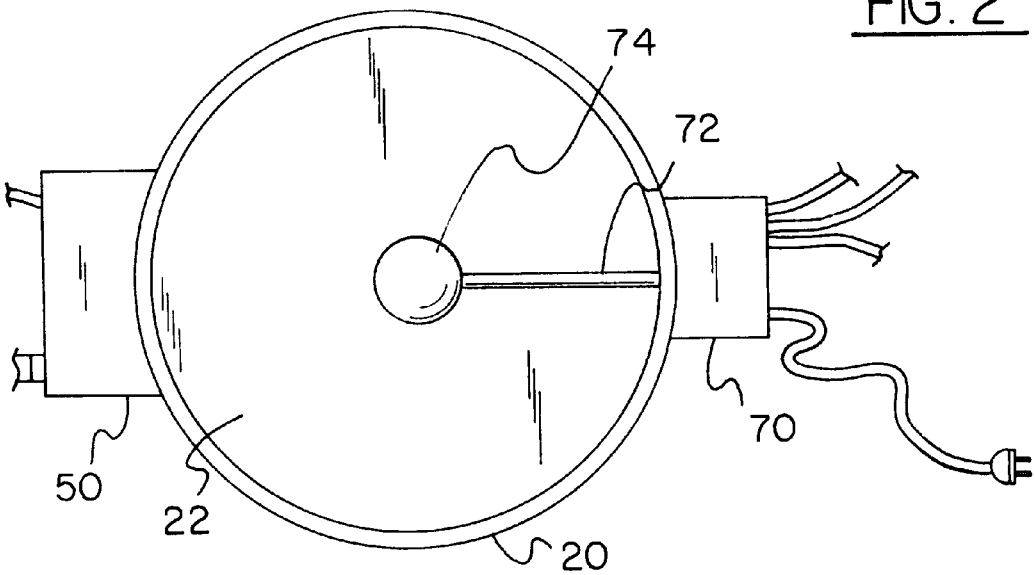
FIG. 2 is a top view of the present invention.
Figure 3:
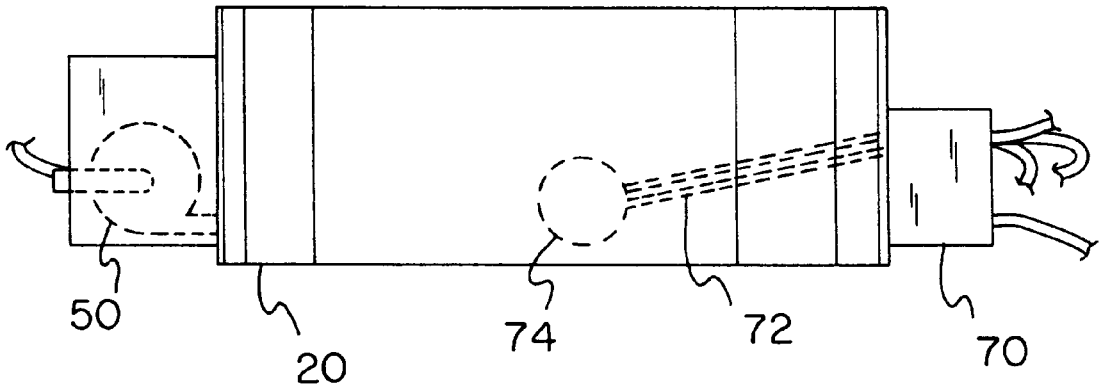
FIG. 3 is a side view of the present invention.
Figure 4:
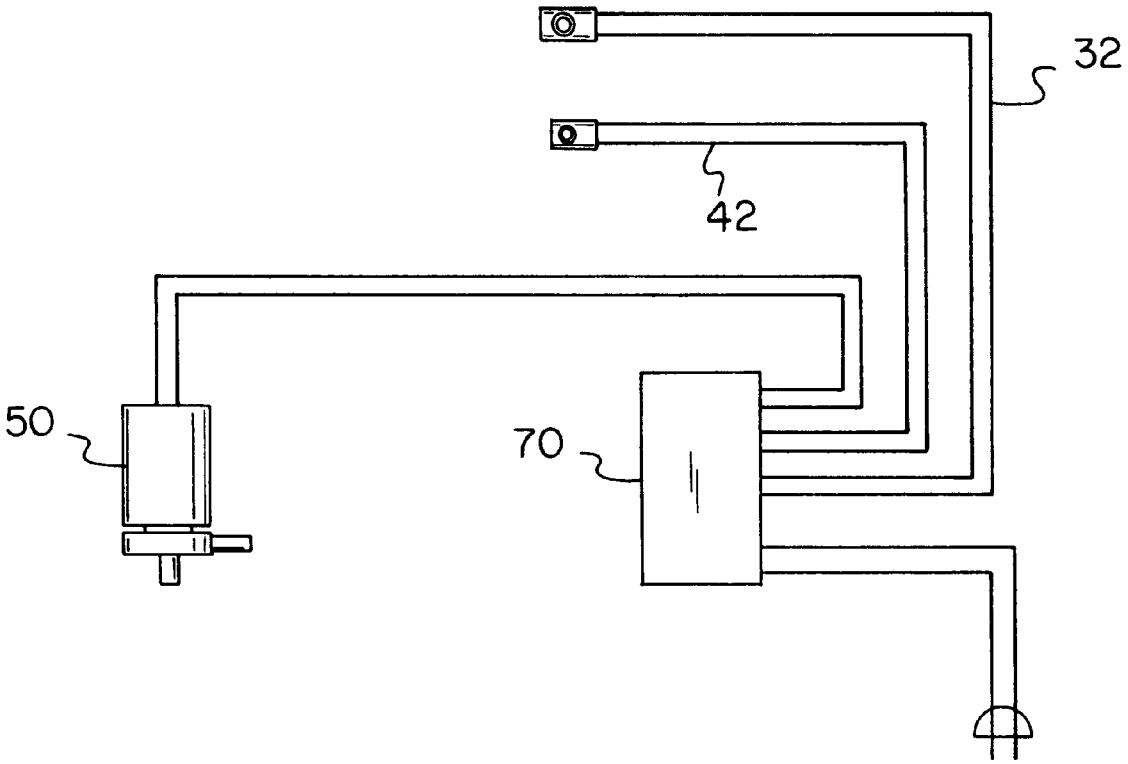
FIG. 4 is a schematic view of a wiring system of the present invention.

With reference now to the drawings, and in particular to FIGS. 1 through 6 thereof, a new leak collection and supply shut off system embodying the principles and concepts of the present invention and generally designated by the reference numeral 10 will be described.

As best illustrated in FIGS. 1 through 6, the leak collection and supply shut off system 10 is designed for use with a water heater 1 that has a tank 2, a water inlet pipe 3, a water outlet pipe 4, and an energy supply line 5. The leak collection and supply shut off system 10 comprises a container 20 that is adapted for positioning under a water heater 1 and holding water. The container 20 has a base 22, a sidewall 24, and an open top 26. A water valve 30 closes the water inlet pipe 3 of the water heater 1 when the level of water in the container 20 is equal to or greater than a predetermined level. An energy shut off device 40 closes the energy supply line 5 of the water heater 1 when the level of water in the container 20 is equal to or greater than the predetermined level. Preferably, the volume of the container 20 is less than about five gallons. Ideally, the volume of the container 20 is about three gallons. Also ideally, the height of the container 20 is less than about eighteen inches and the diameter of an outer perimeter of the container 20 is equal to or greater than the outer diameter of the water heater 1.

Preferably, the water valve 30 is biased towards an open position. The energy shut off device 40 selectively permits passage of energy through the energy shut off device 40 such as a solenoid-activated valve on a gas line or a solenoid-activated electrical switch on the wire providing power to the heating element of an electricity powered water heater 1. The energy shut off device 40 normally permits passage of energy therethrough.

Optionally, a second water valve (not shown) closes the water outlet pipe 4 of the water heater 1 when the level of water in said container 20 is equal to or greater than the predetermined level to prevent the water remaining in a piping system of a house from draining back into the leaking tank 2 of the water heater 1. Ideally, the second water valve is biased towards an open position.

Preferably, a reset switch 66 is operatively connected to the water valve 30. The water valve 30 remains closed until the reset switch 66 is activated. Also preferably, the reset switch 66 is operatively connected to the energy shut off device 40. The energy shut off device 40 closes the energy supply line 5 thereby shutting off gas to the burner or electricity to the heating coil until the reset switch 66 is activated. Ideally, the reset switch 66 is spring biased towards a closed position.

Preferably, the leak collection and supply shut off system 10 further comprises a pump 50 that removes water from the container 20 when the level of water in the container 20 is equal to or greater than the predetermined level. Ideally, the reset switch 66 is operatively connected to the alarm device 60. The alarm device 60 continues producing an audible sound until the reset switch 66 is activated. Most ideally, a third control line 62 extends between the alarm device 60 and the float switch 70. The third control line 62 has a third pair of electrical contacts and a switch E that selectively disconnects power from the alarm device 60 once it notifies the user that there is a leak. This permits the system to continue operating without the sound generated by the alarm device 60 continuing to sound.

Also preferably, the leak collection and supply shut off system 10 further comprises an alarm device 60 that produces an audible sound when the level of water in the container 20 is equal to or greater than the predetermined level.

Preferably, a float switch 70 is provided. A power source is electrically coupled to the float switch 70 to provide power to the float switch 70. The float switch 70 has an electrical switch and a float actuator 72 pivotally coupled to it. The float actuator 72 extends into the container 20 for measuring the level of water therein. Ideally, the float actuator 72 has a buoyant portion 74 thereon.

The float actuator 72 activates the float switch 70 when the level of water in the container 20 is equal to or greater than the predetermined level. The electrical switch permits flow of electricity therethrough when the float switch 70 is actuated and blocks flow of electricity therethrough when the float switch 70 is not actuated.

Ideally, the water valve 30 has a solenoid that is electrically connected to the float switch 70 by a first control line 32. The solenoid selectively opens and closes the water valve 30, the float switch 70 activating the solenoid of the water valve 30 when the level of water in the container 20 is equal to or greater than the predetermined level, the solenoid of the water valve 30 closing the water valve 30 when the solenoid is activated.

Also ideally, the float switch 70 is operatively connected to the energy shut off device 40 by a second control line 42. The float switch 70 activates the energy shut off device 40 when the level of water in the container 20 is equal to or greater than the predetermined level. The energy shut off device 40 closes the energy supply line 5 of the water heater 1 when the energy shut off device 40 is activated. The float switch 70 is also operatively connected to the alarm device 60 and activates the alarm device 60 when the level of water in the container 20 is equal to or greater than a predetermined level.

Also ideally, the float switch 70 selectively activates the pump 50 when the level of water in the container 20 is equal to or greater than the predetermined level. However, the pump 50 does not stay activated like the water valve 30, the energy shut off device 40, and the alarm device 60. The pump 50 turns on and off depending on the level of water in the container 20.

Figure 5:
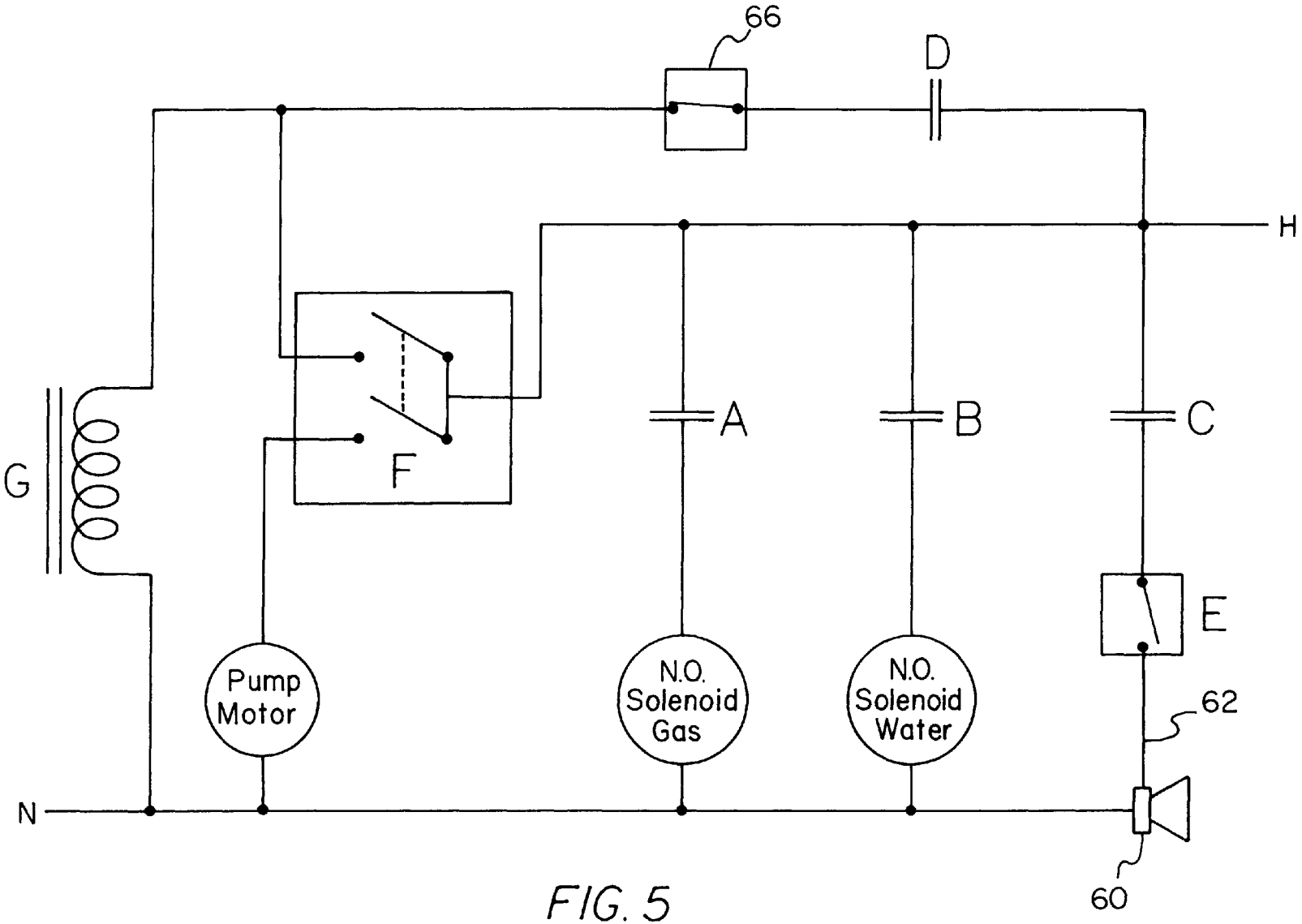
FIG. 5 is a diagram illustrating a wiring scheme of the present invention for use with a gas water heater.

FIG. 5 illustrates a wiring diagram of a leak collection and supply shut off system 10 for use with a gas water heater 1. Contacts F on the float switch 70 close when the water level in the container 20 reaches the predetermined level, activating the pump 50 and energizing a control relay coil G. The control relay coil G closes contacts A, B, and C, which in turn activate the solenoids of the water valve 30 and the energy shut off device 40 as well as activates the alarm device 60. Holding contacts D bring constant power to the control relay coil G, keeping the solenoids in a closed position while allowing the pump 50 to cycle on the float switch 70. Resetting of the system occurs when the normally closed reset switch 66 is pressed, breaking power to the control relay coil G and allowing the solenoids to return to their normally open position. Power to the alarm device 60 may be manually disconnected by switch E.

Figure 6:
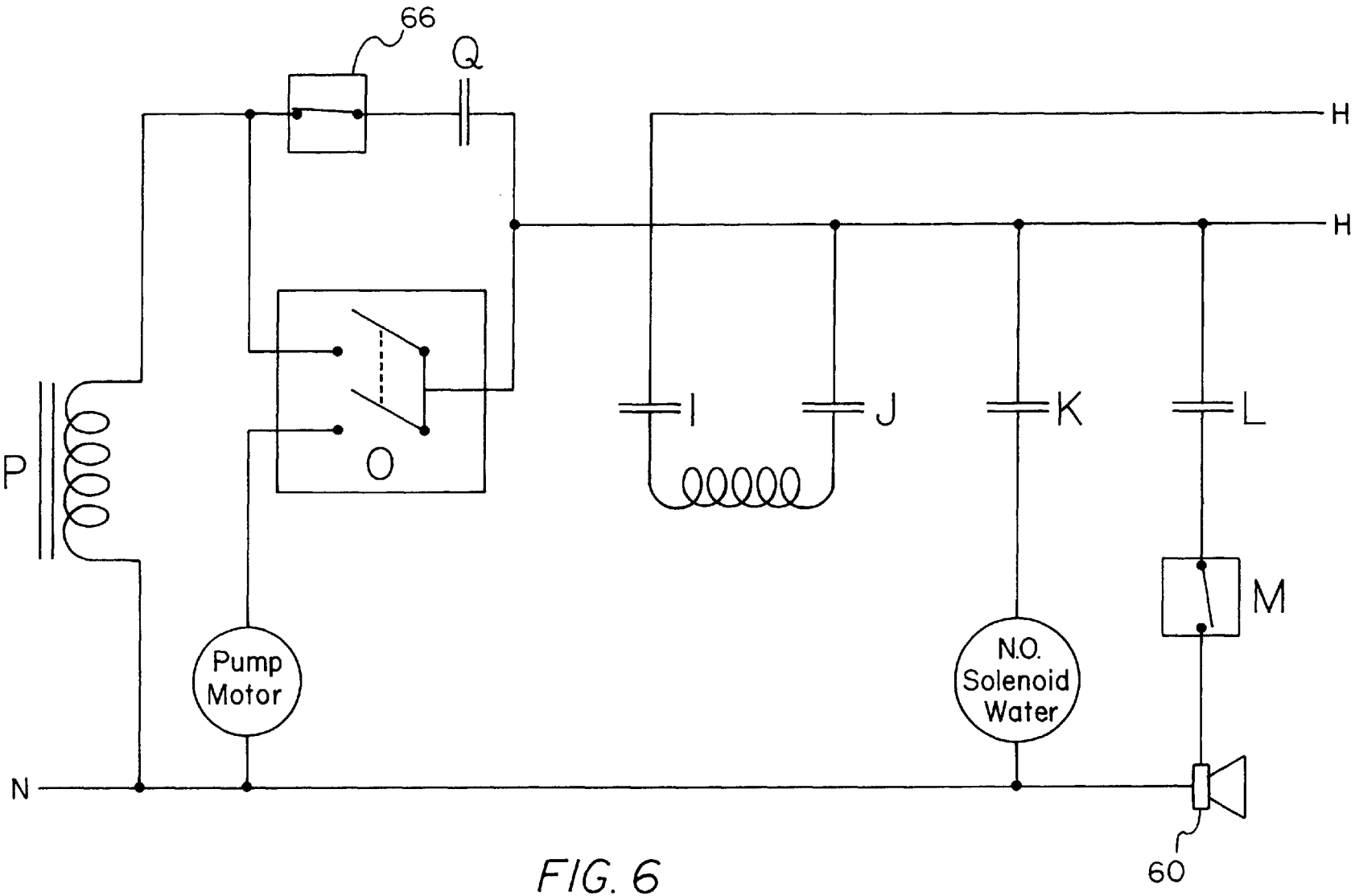
FIG. 6 is a diagram illustrating a wiring scheme of the present invention for use with an electric water heater.

FIG. 6 illustrates a wiring diagram of a leak collection and supply shut off system 10 for use with an electric water heater 1. Contacts O on the float switch 70 close when the water level in the container 20 reaches the predetermined level, activating the pump 50 and energizing a control relay coil P. The control relay coil opens contacts I and J and closes contacts K and L, which in turn disconnects power from the heating element as well as activates the solenoid of the water valve 30 and activates the alarm device 60. Holding contacts Q bring constant power to the control relay coil P, keeping the solenoid in a closed position and the switches I,J to the heating element open while allowing the pump 50 to cycle on the float switch 70. Resetting of the system occurs when the normally closed reset switch 66 is pressed, breaking power to the control relay coil P and allowing the solenoid to return to its normally open position. Power to the alarm device 60 may be manually disconnected by switch M.

In use, the container 20 is placed under the tank 2 of a water heater 1. Power is provided to the system. When the tank 2 of the water heater 1 leaks, water collects in the container 20. When the level of water reaches the predetermined level, the water valve 30 shuts off the supply of water to the tank 2 and the energy shut off device 40 closes the energy supply line 5. The alarm device 60 produces an audible sound. The pump 50 keeps the level of water in the container 20 at the predetermined level so that it doesn't overflow. Once the leak has been remedied, the reset switch 66 is pressed to reset the system.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A leak collection and supply shut off system for a water heater having a tank, a water inlet pipe, a water outlet pipe, and an energy supply line, said system comprising:

a container being adapted for positioning underneath a water heater and being for holding water therein, said container having a base, a sidewall, and an open top;

a water valve for closing a water inlet pipe of the water heater when the level of water in said container is equal to or greater than a predetermined level;

a second water valve for closing the water outlet pipe of the water heater when the level of water in said container is equal to or greater than a predetermined level to prevent the water remaining in a piping system from draining back into the leaking tank of the water heater, said second water valve being biased towards an open position;

an energy shut off device for closing an energy supply line of the water heater when the level of water in said container is equal to or greater than said predetermined level;

a pump for removing water from said container, said pump being activated when the level of water in said container is equal to or greater than said predetermined level;

an alarm device for producing an audible sound when the level of water in said container is equal to or greater than said predetermined level;

a spring biased reset switch being operatively connected to said water valve, said energy shut off device, and said alarm device;

said water valve remaining closed until said reset switch is activated;

said energy shut off device closing the energy supply line such that power is cut off to that water heater until said reset switch is activated;

said alarm device producing an audible sound until said reset switch is activated;

a float switch having an electrical switch and a float actuator pivotally coupled thereto, said float actuator extending into said container for measuring the level of water therein, said float actuator having a buoyant portion thereon;

said float actuator activating said float switch when the level of water in said container is equal to or greater than said predetermined level;

a power source being electrically connected to said float switch;

said water valve having a solenoid being electrically connected to said float switch, said solenoid selectively opening and closing said water valve, said float switch activating said solenoid of said water valve when the level of water in said container is equal to or greater than said predetermined level, said solenoid of said water valve closing said water valve when said solenoid is activated;

said float switch activating said energy shut off device when the level of water in said container is equal to or greater than said predetermined level, said energy shut off device closing the energy supply line of the water heater when said energy shut off device is activated;

said electrical switch permitting flow of electricity therethrough when said float switch is actuated, said electrical switch blocking flow of electricity therethrough when said float switch is not actuated;

said float switch activating said alarm device when the level of water in said container is equal to or greater than said predetermined level;

said float switch selectively activating said pump when the level of water in said container is equal to or greater than said predetermined level.

* * * * *